US010141003B2

(12) United States Patent
Ma et al.

(10) Patent No.: US 10,141,003 B2
(45) Date of Patent: Nov. 27, 2018

(54) NOISE LEVEL ESTIMATION

(71) Applicant: DOLBY LABORATORIES LICENSING CORPORATION, San Francisco, CA (US)

(72) Inventors: Guilin Ma, Beijing (CN); C. Phillip Brown, Castro Valley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/316,092

(22) PCT Filed: Jun. 8, 2015

(86) PCT No.: PCT/US2015/034733
§ 371 (c)(1),
(2) Date: Dec. 2, 2016

(87) PCT Pub. No.: WO2015/191470
PCT Pub. Date: Dec. 17, 2015

(65) Prior Publication Data

US 2017/0103771 A1 Apr. 13, 2017

Related U.S. Application Data

(60) Provisional application No. 62/020,809, filed on Jul. 3, 2014.

(30) Foreign Application Priority Data

Jun. 9, 2014 (CN) ..... 2014 1 0275429
Jul. 30, 2014 (EP) ..... 14179096

(51) Int. Cl.
*G10L 21/0232* (2013.01)
*G10L 21/0264* (2013.01)

(52) U.S. Cl.
CPC ..... *G10L 21/0232* (2013.01); *G10L 21/0264* (2013.01)

(58) Field of Classification Search
CPC . H04L 1/0054; H04B 1/1036; G10L 21/0208; G10L 21/0232;
(Continued)

(56) References Cited

U.S. PATENT DOCUMENTS 4,173,000 A * 10/1979 Singer ..... H03K 3/84 331/78
4,375,620 A * 3/1983 Singer ..... H03K 3/84 331/78
(Continued)

FOREIGN PATENT DOCUMENTS

EP 1450354 8/2004
EP 1450354 A1 * 8/2004
(Continued)

OTHER PUBLICATIONS

Erkelens et al. "Tracking of Nonstationary Noise Based on Data-Driven Recursive Noise Power Estimation" Aug. 6, 2008, IEEE https://ieeexplore.ieee.org/stamp/stamp.jsp?tp=&arnumber=4566085.*
(Continued)

*Primary Examiner* — Yogeshkumar Patel

(57) ABSTRACT

Example embodiments disclosed herein relate to noise level estimation. A method for noise level estimation is disclosed. The method includes, responsive to an increase of a signal level of a noise signal, calculating an impulsive noise probability of the noise signal, the impulsive noise probability indicating a likelihood that the noise signal is an impulsive noise. The method also includes determining a variable smoothing factor for noise level estimation based on the impulsive noise probability, the variable smoothing factor being associated with a previous estimated level of the
(Continued)

noise signal. The method further includes smoothing the noise signal with the variable smoothing factor so as to determine a current estimated level of the noise signal. Corresponding system and computer program products are also disclosed.

19 Claims, 6 Drawing Sheets

(58) Field of Classification Search
CPC . G10L 2021/02165; G10L 2021/02166; G10L 21/0224; G10L 21/0264; G10L 21/0216; G10L 25/03; G10L 21/02165; G10L 15/20; G10L 21/034; G10L 2210/108; G10L 2210/3023; H04M 3/18; H04M 3/41; H04R 2225/43; H04R 2410/05; H03G 3/32
USPC ..... 381/94.1, 56, 71.1, 71.11, 71.12, 314, 381/94.2; 704/E15.039, 19.023, 21.002, 704/219, 226
See application file for complete search history.

(56) References Cited

U.S. PATENT DOCUMENTS 4,470,022 A * 9/1984 Cernius ..... H03B 29/00 331/78
5,659,622 A * 8/1997 Ashley ..... G10L 21/0208 381/94.1
5,668,927 A * 9/1997 Chan ..... G10L 21/0208 704/214
6,289,309 B1 * 9/2001 deVries ..... G10L 21/0208 381/94.1
6,643,337 B1 * 11/2003 Pierce ..... G01S 7/024 342/189
6,744,813 B1 * 6/2004 Ko ..... H04B 3/46 375/224
7,139,711 B2 * 11/2006 Grover ..... G10L 21/0208 704/260
8,239,194 B1 * 8/2012 Paniconi ..... G10L 21/0216 381/71.1
9,264,808 B2 * 2/2016 Zhou ..... G10K 11/178
2003/0026438 A1 * 2/2003 Ray ..... G10K 11/178 381/71.11
2004/0071363 A1 * 4/2004 Kouri ..... G06K 9/00516 382/276
2004/0264706 A1 * 12/2004 Ray ..... G10K 11/178 381/71.11
2005/0278171 A1 * 12/2005 Suppappola ..... G10L 19/012 704/227
2006/0078044 A1 * 4/2006 Norrell ..... H04L 5/0046 375/222
2006/0222098 A1 * 10/2006 Sedarat ..... H04L 5/0046 375/260
2006/0253515 A1 * 11/2006 Sedarat ..... H04L 27/2647 708/446
2006/0271362 A1 * 11/2006 Katou ..... G10L 21/0208 704/233
2007/0055508 A1 * 3/2007 Zhao ..... H04R 25/55 704/226
2007/0183526 A1 * 8/2007 Norrell ..... H04L 25/03159 375/265
2007/0276660 A1 * 11/2007 Pinto ..... G10L 21/0208 704/219
2008/0077403 A1 * 3/2008 Hayakawa ..... G10L 15/20 704/233
2008/0118082 A1 * 5/2008 Seltzer ..... G10L 21/0208 381/94.1
2008/0152167 A1 * 6/2008 Taenzer ..... H04R 3/005 381/94.2
2009/0016469 A1 * 1/2009 Li ..... H03M 13/3707 375/341
2009/0052594 A1 * 2/2009 Li ..... H03M 13/373 375/341
2009/0299742 A1 * 12/2009 Toman ..... G10L 21/0208 704/233
2010/0020986 A1 * 1/2010 Nemer ..... H04R 3/00 381/94.1
2010/0094625 A1 * 4/2010 Mohammad ..... G10L 25/48 704/233
2010/0145689 A1 * 6/2010 Li ..... G10L 21/0208 704/210
2010/0223054 A1 * 9/2010 Nemer ..... H04R 3/007 704/219
2010/0239098 A1 9/2010 Christoph
2010/0254539 A1 * 10/2010 Jeong ..... G10L 21/0272 381/56
2011/0029310 A1 * 2/2011 Jung ..... G10L 21/0208 704/233
2011/0103615 A1 * 5/2011 Sun ..... G10L 21/0208 381/94.3
2011/0305345 A1 12/2011 Bouchard
2012/0022336 A1 * 1/2012 Teixeira ..... A61B 5/0205 600/300
2012/0022844 A1 * 1/2012 Teixeira ..... A61B 5/0205 703/11
2012/0051548 A1 * 3/2012 Visser ..... G10L 21/0208 381/56
2012/0123771 A1 * 5/2012 Chen ..... G10L 21/0208 704/226
2012/0158404 A1 * 6/2012 Shin ..... G10L 21/0216 704/233
2013/0158989 A1 * 6/2013 Song ..... G10L 21/0232 704/226
2014/0072132 A1 * 3/2014 Gautama ..... H03G 3/345 381/71.1
2014/0079244 A1 * 3/2014 Vrazic ..... G10K 11/16 381/94.1
2014/0105262 A1 * 4/2014 Alloin ..... H04B 3/46 375/222
2014/0112379 A1 * 4/2014 Biyani ..... H04B 1/1036 375/222
2014/0226827 A1 * 8/2014 Abdollahzadeh Milani ..... G10L 21/0224 381/56
2014/0244245 A1 * 8/2014 Briot ..... G10L 21/0208 704/211
2015/0030180 A1 * 1/2015 Sun ..... G10L 21/0316 381/94.2
2015/0032445 A1 * 1/2015 Souden ..... G10L 21/0264 704/208
2015/0071461 A1 * 3/2015 Thyssen ..... G10L 21/0208 381/94.1
2015/0230023 A1 * 8/2015 Fujieda ..... G10L 21/0232 381/71.1
2016/0191362 A1 * 6/2016 Hwang ..... H04L 43/0864 370/253

FOREIGN PATENT DOCUMENTS

EP 2149879 2/2010
EP 2234105 9/2010
EP 2750130 7/2014
WO 2005/038773 4/2005
WO 2005/109404 11/2005
WO 2008/115445 9/2008
WO 2009/043066 4/2009
WO 2011/041738 4/2011
WO 2011/159858 12/2011
WO 2013/006175 1/2013
WO 2013/140399 9/2013

OTHER PUBLICATIONS

Rangachari et al. "A noise-estimation algorithm for highly non-stationary environments" Dec. 17, 2004, ScienceDirect https://www.sciencedirect.com/science/article/pii/S0167639305002001.*

(56) References Cited

OTHER PUBLICATIONS

Doblinger, Gerhard "Computationally Efficient Speech Enhancement by Spectral Minima Tracking in Subbands" Proc. Eurospeech, pp. 1513-1516, 1995.
Martin, R. "Noise Power Spectral Density Estimation Based on Optimal Smoothing and Minimum Statistics" IEEE Transactions on Speech and Audio Processing, pp. 504-512, vol. 9, Issue 5, Jul. 2001.
Martin, Rainer "Bias Compensation Methods for Minimum Statistics Noise Power Spectral Density Estimation" Signal Processing, vol. 86, Issue 6, Jun. 2006, pp. 1215-1229.
Cohen, I. et al "Noise Estimation by Minima Controlled Recursive Averaging for Robust Speech Enhancement" IEEE Signal Processing Letters, vol. 9, Issue 1, pp. 12-15, Jan. 2002.
Cohen, Israel "Noise Spectrum Estimation in Adverse Environments: Improved Minima Controlled Recursive Averaging" IEEE Transactions on Speech and Audio Processing, vol. 11, Issue 5, pp. 466-475.
Rangachari, S. et al "A Noise Estimation Algorithm with Rapid Adaptation for Highly Nonstationary Environments" IEEE International Conference on Acoustics, Speech, and Signal Processing, vol. 1, pp. I-305-I-308, 2004.
Hirsch, H.G. et al "Noise Estimation Techniques for Robust Speech Recognition" IEEE International Conference on Acoustics, Speech, and Signal Processing, vol. 1, pp. 153-156, 1995.
Loizou, Philipos C. "Speech Enhancement: Theory and Practice" first edition, CRC Press, Jun. 7, 2007.
Godsill, S.J. et al "A Bayesian Approach to the Detection and Correction of Error Bursts in Audio Signals" IEEE International Conference on Acoustics, Speech, and Signal Processing, vol. 2, pp. 261-264, 1992.
Rangachari, S. et al "A Noise-Estimation Algorithm for Highly Non-Stationary Environments" Speech Communication, vol. 48, Issue 2, Feb. 2006, pp. 220-231.
Cohen, I. et al "Speech Enhancement for Non-Stationary Noise Environments" vol. 81, Issue 11, Nov. 2001, pp. 2403-2418.
Martin, Rainer "Noise Power Spectral Density Estimation Based on Optimal Smoothing and Minimum Statistics" IEEE Transactions on Speech and Audio Processing, vol. 9, Issue 5, pp. 504-512, Jul. 2001.
Godsill, S. et al "Statistical Reconstruction and Analysis of Autoregressive Signals in Impulsive Noise Using the Gibbs Sampler" IEEE Transactions on Speech and Audio Processing, vol. 6, No. 4, Jul. 1998, pp. 352-372.

* cited by examiner

NOISE LEVEL ESTIMATION

CROSS REFERENCE TO RELATED APPLICATIONS

This application claims priority from Chinese priority patent application No. 201410275429.1 filed 9 Jun. 2014; U.S. Provisional Patent Application No. 62/020,809 filed 3 Jul. 2014 and European Patent Application No. 14179096.4 filed 30 Jul. 2014 which are hereby incorporated by reference in their entirety.

TECHNOLOGY

Example embodiments disclosed herein generally relate to audio processing, and more specifically, to a method and system for noise level estimation.

BACKGROUND

Real-life noise may consist of different types of noises: stationary and non-stationary noises. Non-stationary noise may include two classes of noise: an abrupt increase of noise floor and an impulsive noise. Both are particularly challenging to deal with respect to audio processing where a noise signal is concerned. As used herein, an abrupt increase of noise floor refers to the noise floor suddenly increasing from one level to another level and maintaining substantially stationary during a relative long period of time, Impulsive noise refers to a non-stationary noise when the level increases suddenly and then drops down within a short period of time. Usually, in audio processing, such as speech enhancement, audio play, or noise compensation, the noise level is required to be tracked. For example, in headphone noise compensation, the estimated level of a noise signal may directly impact the gain applied to the audio signal. The actual signal level of a noise signal generally cannot be applied as it changes rapidly over time, especially when an abrupt increase of noise floor or an impulsive noise occurs. As such, a noise signal input should be processed to obtain an estimated noise level that can be used in audio processing, as illustrated in FIG. 1.

Noise estimation techniques have been developed mainly in the framework of speech processing, especially in speech enhancement. These techniques, for example, may be divided into minimum tracking, time-recursive averaging, histogram based noise estimation, and quantile based noise estimation and so on. Concerning the two classes of non-stationary noises, the estimated noise level is desired to follow the abrupt increase of noise floor and to resist a drift of noise estimation during the short-period impulsive noise. However, the existing noise estimation methods are either too sensitive to the abrupt increase of noise floor or too sensitive to the impulsive noise, thereby disabling the estimate of a robust level of noise in these two noise scenarios.

In view of the foregoing, there is a need in the art for a solution for appropriately estimating noise levels for both impulsive noises and the abrupt increasing of a noise floor.

SUMMARY

In order to address at least one of the foregoing and other potential problems, example embodiments disclosed herein proposes a method and system for noise level estimation.

In one aspect, example embodiments disclosed herein provide a method for noise level estimation. The method includes responsive to an increase of a signal level of a noise signal, calculating an impulsive noise probability of the noise signal, the impulsive noise probability indicating a likelihood that the noise signal is an impulsive noise; determining a variable smoothing factor for noise level estimation based on the impulsive noise probability, the variable smoothing factor being associated with a previously estimated level of the noise signal and smoothing the noise signal with the variable smoothing factor so as to determine a current estimated level of the noise signal. Embodiments in this regard further include a corresponding computer program product.

In another aspect, example embodiments disclosed herein provide a system for noise level estimation. The system includes an impulsive noise probability calculation unit, configured to calculate an impulsive noise probability of a noise signal responsive to an increase of a signal level of the noise signal, the impulsive noise probability indicating a likelihood that the noise signal is an impulsive noise a smoothing factor determination unit, configured to determine a variable smoothing factor for noise level estimation based on the impulsive noise probability, the variable smoothing factor being associated with a previous estimated level of the noise signal and a noise level estimation unit, configured to smooth the noise signal with the variable smoothing factor so as to determine a current estimated level of the noise signal.

Through the following description, it would be appreciated that in accordance with example embodiments disclosed herein, the estimated noise level can be resistant from drifting in the scenario of impulsive noise based on the variable smoothing factor that is determined from the impulsive noise probability. Other advantages achieved by example embodiments disclosed herein will become apparent through the following descriptions.

DESCRIPTION OF DRAWINGS

Through the following detailed description with reference to the accompanying drawings, the above and other objectives, features and advantages of example embodiments disclosed herein will become more comprehensible. In the drawings, several example embodiments disclosed herein will be illustrated in an example and non-limiting manner, wherein:

FIG. 5(*b*)-(*d*) illustrate graphs of the parameters used in the example embodiment of FIG. 5(*a*);

Throughout the drawings, the same or corresponding reference symbols refer to the same or corresponding parts.

DESCRIPTION OF EXAMPLE EMBODIMENTS

Figure 1:
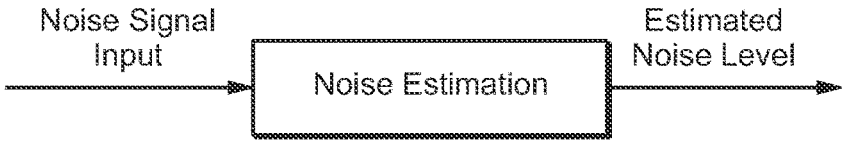
FIG. 1 illustrates a general diagram of noise level estimation.

Principles of the example embodiments disclosed herein will now be described with reference to various example embodiments illustrated in the drawings. It should be appreciated that depiction of these embodiments is only to enable those skilled in the art to better understand and further implement the example embodiments, not intended for limiting the scope of the example embodiments disclosed herein in any manner.

As mentioned above, an abrupt increase of noise floor and an impulsive noise are particularly challenging for audio processing where the noise signal is concerned and in noise estimation, the estimated noise level is desired to follow the abrupt increase of noise floor and to resist a drift of noise estimation during the short-period impulsive noise floor. In this sense, the increase of noise floor and the impulsive noise should be distinguished from the noise signal input, and then different smoothing factors can be applied to smooth the noise signal input. However, at the beginning of the increase, there is no discrimination between a sudden increase of noise floor and an impulsive noise. An easy solution to distinguish is to look-ahead and buffer enough length of signal to build up sufficient confidence on the signal type and later process it accordingly which, however, may cause large latency.

Example embodiments disclosed herein propose a method and system for robust noise level estimation, which can track the noise level closely and smoothly, follow the increase of noise floor fast and resist the short-period impulsive noise. The method and system of the example embodiments disclosed herein introduce impulsive noise probability and adaptive smoothing factors so as to achieve low-latency and accurate classification of signal types and robust noise level estimation.

Figure 2:
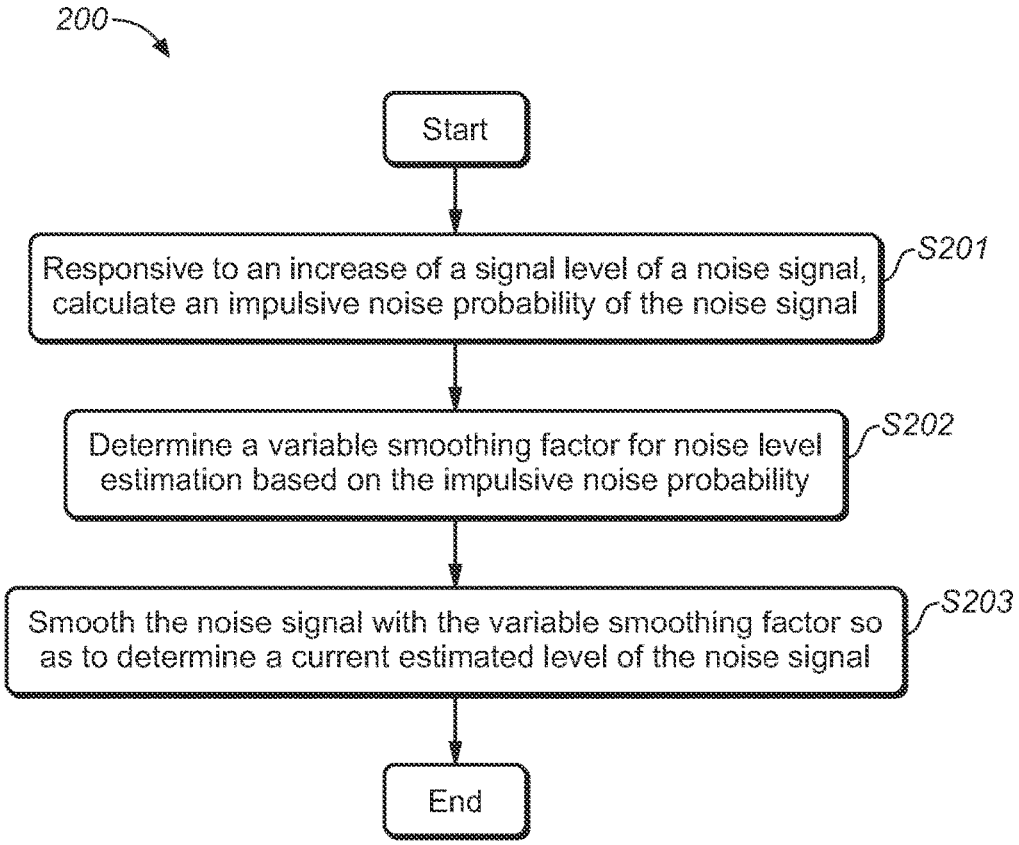
FIG. 2 illustrates a flowchart of a method for noise level estimation in accordance with an example embodiments disclosed herein.

Reference is first made to FIG. 2 which shows a flowchart of a method 200 for noise level estimation in accordance with example embodiments disclosed herein.

At step 201, responsive to an increase of a signal level of a noise signal, an impulsive noise probability of the noise signal is calculated. The impulsive noise probability indicates a likelihood that the noise signal is an impulsive noise.

In some example embodiments disclosed herein, the noise signal input may be, for example, obtained from microphone input or processed microphone signals, and may be any daily-life stationary or non-stationary noise. As the level of noise is a function of frequency and time, the noise level estimation may be performed band by band, or on a broadband. The noise level estimation at different frequency bands may be performed concurrently or in sequence. As such, the noise signal to be estimated may be a signal in one of a plurality of frequency bands of the noise input signal, or is a broadband signal of the noise input signal.

One purpose of the example embodiments disclosed herein is to quickly and accurately distinguish the increase of noise floor and the impulsive noise, both of which have an increasing signal level at early stage. The increasing signal level may be used to trigger the calculation of the impulsive noise probability. In an example embodiments disclosed herein, an onset detector may be used to track the onset of the noise signal, and the probability of signal level increasing may be represented as an onset probability. As such, before calculating the impulsive noise probability, an onset probability of the noise signal may be determined, and the onset probability indicates the likelihood of the increase of the signal level. The determination of onset probability will be discussed with more details below with reference to FIG. 3.

Responsive to the signal level detected as being increasing, operations are performed to calculate the impulsive noise probability indicating the likelihood of the noise signal being an impulsive noise. The impulsive noise probability is between 0 and 1. When the impulsive noise probability is calculated, the probability of noise floor increase may also be determined by 1 minus the impulsive noise probability.

As referred herein, the abrupt increase of noise floor refers to the noise floor suddenly increasing from one level to another level and maintaining a substantially stationary level within a relative long period of time, and the impulsive noise refers to a non-stationary noise the level of which increases suddenly and then drops down within a short period of time. For instance, in a real-life scenario, a person in a corner shop is exposed to a relatively quiet indoor environment. When the person opens the door, they suddenly enters an environment of high-level ambient traffic noise and may hear a loud door slam afterwards on top of the traffic noise. In this scenario, the traffic noise may result in an increase of the noise floor, and the noise of a door slam, the level of which drops down quickly, may be classified into the impulsive noise.

The calculation of impulsive noise probability will be discussed with more details below with reference to FIG. 3.

The method 200 then proceeds to step S202, where a variable smoothing factor is determined for noise level estimation based on the impulsive noise probability at step S201.

As used here, the variable smoothing factor is associated with a previously estimated level of the noise signal. The variable smoothing factor is used to smooth the noise signal so as to have the estimated level of the noise signal following the increase of the noise floor quickly and resist the short-period impulsive noise. Since the smaller smoothing factor may result in the estimated noise level following the actual level of the noise signal more quickly and versa vice, if the calculated impulsive noise probability is smaller, which means the noise signal is probably an increase of noise floor, then the variable smoothing factor is determined to be smaller and versa vice.

Generally, even without the increase of noise floor and impulsive noise, the noise signal input may also be smoothed with a constant smoothing factor, which is referred to as a reference smoothing factor herein, so as to produce a smoothed noise signal with a more smoothed level for later processing. Therefore, the determined variable smoothing factor at step S202 may be between this constant smoothing factor and 1. The determination of a variable smoothing factor will be discussed with more details below with reference to FIG. 3.

The method 200 then proceeds to step S203, where the noise signal is smoothed with the variable smoothing factor so as to determine a current estimated level of the noise signal. This estimated level may be used in later audio processing, such as noise compensation, speech enhancement or the like. This step will also be discussed with more details below with reference to FIG. 3.

Figure 3:
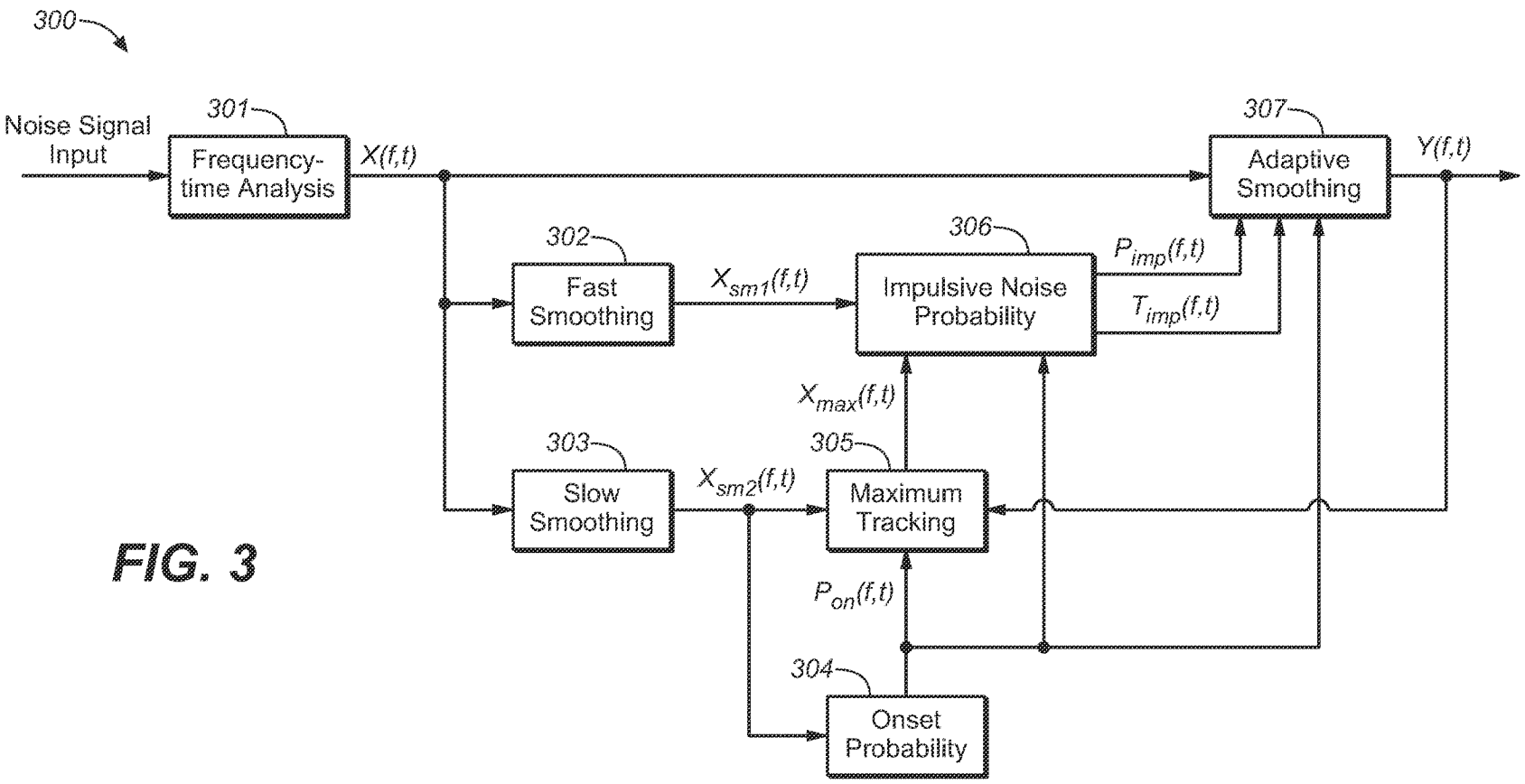
FIG. 3 illustrates a schematic diagram of noise level estimation in accordance with an example embodiments disclosed herein.

FIG. 3 illustrates a schematic diagram 300 of noise level estimation in accordance with an example embodiments disclosed herein. With reference to FIG. 3, the processing of noise level estimation will be described in more detail. It should be noted that one or more of the blocks shown in FIG. 3 may be optional and thus can be omitted in some embodiments, and some of the blocks may be combined as one block or one block may be divided into multiple blocks in practice. The scope of the example embodiments disclosed herein are not limited in this regard.

The operations of the blocks illustrated are described in the following.

The Block of Frequency-Time Analysis 301

As the noise signal input is varied with time and frequency, the processing of noise level estimation may be performed for each of a plurality of frequency bands and the parameters may be tuned band by band. Then, the noise signal to be estimated may be a signal in one of a plurality of frequency bands of a noise input signal or is a broadband signal of the noise input signal. For example, the frequency of a noise signal input may be divided into five bands, B1 (f≤700 Hz), B2 (700 Hz<f≤1000 Hz), B3 (1000 Hz<f≤2000 Hz), B4 (2000 Hz<f≤6000 Hz), and B5 (f>6000 Hz), and the noise signal to be estimated may be at one of the five bands.

Under this condition, the output of block 301 may be X(f,t), wherein X(f,t) may represent the actual signal level of a noise signal in one frequency band and at a point of time in one example embodiment.

It should be noted that the block 301 may be optional in other embodiments if a broadband noise signal is used in the processing. In this case, the noise signal may be represented as X(t) for example.

In some embodiments, this block may also determine the processing interval Δt of the noise level estimation, that is, it may output the noise signal X(f,t) for every other processing interval Δt. The processing interval Δt may be determined by the sample rate. For example, this block may output the noise signal X(f,t) every other sample, or every other ten samples, or the like.

The Blocks of Fast Smoothing and Slow Smoothing 302, 303

Two smoothers may be used to smooth the noise signal before it is input into the blocks of onset probability, maximum tracking or impulsive noise probability. As the actual level of the noise signal changes too frequently, pre-smoothing operations may produce a more smoothed noise signal for later processing.

In some embodiments, the block of fast smoothing 302 may utilize a small smoothing factor to smooth the noise signal so as to track the actual noise level quickly. For example, the block of fast smoothing 302 may operate in the log domain as follows:

$$X_{sm1,dB}(f,t)=\alpha_1 X_{sm1,dB}(f,t-\Delta t)+(1-\alpha_1)X_{dB}(f,t) \quad (1)$$

wherein $X_{sm1,dB}(f,t)$ represents the fast smoothed noise signal in log domain at a point of time t; $X_{sm1,dB}(f,t-\Delta t)$ represents the fast smoothed noise signal in log domain at a previous point of time t−Δt; $X_{dB}(f,t)$ represent the raw noise signal in log domain at the point of time t; and $\alpha_1$ represents a linear domain smoothing factor and is between 0 and 1. In one example, the value of $\alpha_1$ may correspond to 0.01 seconds for the signal to decay to 50% of its final value.

In some embodiments, the block of slow smoothing 303 may utilize a large smoothing factor to smooth the noise signal so as to track the actual noise level slowly. For example, the block of slow smoothing 303 may operate in the log domain as follows:

$$X_{sm2,dB}(f,t)=\alpha_2 X_{sm2,dB}(f,t-\Delta t)+(1-\alpha_2)X_{dB}(f,t) \quad (2)$$

wherein $X_{sm2,dB}(f,t)$ represents the slow smoothed noise signal in log domain at a point of time t; $X_{sm2,dB}(f,t-\Delta t)$ represents the slow smoothed noise signal in log domain at a previous point of time t−Δt; $X_{dB}(f,t)$ represent the raw noise signal in log domain at the point of time t; and $\alpha_2$ represents a linear domain smoothing factor and is between 0 and 1. In one example, the value of $\alpha_2$ may correspond to 0.01 seconds for the signal to decay to 90% of its final value.

It should be noted that both or one of blocks 302 and 303 may be omitted in some embodiments. The scope of the present invention is not limited in this regard.

The Block of Onset Probability 304

The onset probability of the noise signal indicates a likelihood of the increase of the signal level, and may be used to trigger the calculation of impulsive noise probability. In one example embodiment, the input of the onset probability block 304 is the slow smoothed noise signal $X_{sm2}(f,t)$, as illustrated in FIG. 3. It should be noted that, in other embodiments, this block may have the fast smoothed noise signal $X_{sm1}(f,t)$ or the raw noise signal X(f,t) as the input.

In some example embodiments, the onset probability is determined based on the crest factor, which is the peak to root-mean-square (rms) ratio. In one example, if the crest factor is larger than a threshold, the onset probability may be determined as 1, and otherwise may be determined as 0. In other examples, the onset probability may be measured as a continuous value between 0 and 1, and may be smoothed from the previous onset probability in order to avoid a sudden change. In such examples, the onset probability may be smoothed with a time constant (smoothing factor) and may be calculated as follows:

$$P_{on}(f,t)=\alpha_p P_{on}(f,t-\Delta t)+(1-\alpha_p)I(f,t) \quad (3)$$

wherein $P_{on}(f,t)$ represents the onset probability of the noise signal at a frequency f and a point of time t; $P_{on}(f,t-\Delta t)$ represents the onset probability at a previous point of time t−Δt; and $\alpha_p$ is between 0 and 1 and represents a linear domain smoothing factor represented by the time it takes for the onset probability to decay to 90% of its final value. In one example, such a time may be 4.3 ms. I(f,t) indicates a comparison of the crest factor and the threshold. It may be determined in the following equation:

$$I(f,t)=\begin{cases}1, & \text{when } c_{dB}(f,t)\geq L_{dB}(f)\\ 0, & \text{when } c_{dB}(f,t)<L_{dB}(f)\end{cases} \quad (4)$$

wherein $C_{dB}(f,t)$ represents the crest factor in log domain and may be calculated in the following equations (5) and (6); and $L_{dB}(f)$ represents the threshold of crest factor in log domain.

$$C_{dB}(f,t)=X_{sm2,dB}(f,t)-X_{sm3,dB}(f,t) \quad (5)$$

$$X_{sm3,dB}(f,t)=\alpha_g X_{sm3,dB}(f,t-\Delta t)+(1-\alpha_g)X_{sm2,dB}(f,t) \quad (6)$$

wherein $X_{sm2,dB}(f,t)$ represents the output $X_{sm2}(f,t)$ of the slow smoothing block 303 in log domain; $X_{sm3,dB}(f,t)$ represents a further smoothed noise signal in log domain approximating a rms estimation and $\alpha_g$ represents the smoothing factor for $X_{sm3,dB}(f,t)$ and is between 0 and 1, which, in one example, may correspond to 2 seconds for $X_{sm3,dB}(f,t)$ to decay to 90% of its final value. As mentioned above, $X_{sm2,dB}(f,t)$ may also be replaced by the fast smoothed noise signal $X_{sm1}(f,t)$ or the raw noise signal X(f,t).

The threshold of crest factor $L_{dB}(f)$ may be different for a different frequency band in the case where the noise level estimation is done band by band, and otherwise may remain the same for a broadband. For example, if the frequency of the noise signal is divided into five frequency bands and for each frequency band, the threshold may be different, such as:

$$L_{db}(f) = \begin{cases} 20 & f \le 700 \text{ Hz} \\ 40 & 700 \text{ Hz} < f \le 1000 \text{ Hz} \\ 20 & 1000 \text{ Hz} < f \le 2000 \text{ Hz} \\ 10 & 2000 \text{ Hz} < f \le 6000 \text{ Hz} \\ 10 & f > 6000 \text{ Hz} \end{cases} \quad (7)$$

There are many other ways to calculate the onset probability besides the above approach. For example, if the signal level increases to be higher than a threshold within a predetermined period of time, the onset probability may be determined as 1. The scope of the example embodiments disclosed herein are not limited in this regard.

The Blocks of Maximum Tracking and Impulsive Noise Probability 305 and 306

As noted in the above, the onset probability is input to the block of impulsive noise probability 306 and is used to trigger the calculation of the impulsive noise probability. In accordance with some example embodiments disclosed herein, with the input of the onset probability, the calculation of the impulsive noise probability may comprise the following steps: (1) setting an initial value of the impulsive noise probability as the onset probability, when the onset probability is higher than a first predetermined probability threshold; (2) determining whether the noise signal has a decay trend; and (3) calculating the impulsive noise probability of the noise signal based on whether the noise signal has the decay trend.

As can be seen from the above, the calculation of impulsive noise probability may be triggered by the onset probability. For example, if the onset probability is higher than 0.5, the calculation of impulsive noise probability begins and the initial value of the impulsive noise probability may be set as the onset probability. It should be noted that the first predetermined probability threshold may be other values between 0 and 1, and the initial value of the impulsive noise probability may be set as other values, such as a value lower or higher than the onset probability, or a fixed value.

In other example embodiments disclosed herein, an impulse status indicator may be used to indicate whether the noise signal is currently estimated as an impulsive noise or not. In one embodiment, this impulse status indicator may be a Boolean variable. That is, if the noise signal is currently estimated as an impulsive noise, the impulse status indicator may be represented as "True" and otherwise, it may be represented as "False." It should be noted that the impulse status indicator may have other values. For example, it may have a value of 0 or 1 to indicate the status of impulse. In these embodiments, before beginning to calculate the impulsive noise probability, the impulse status indicator may first be determined as False. Then, when the onset probability is higher than the first predetermined probability threshold, the calculation of impulsive noise probability may begin and the impulse status indicator may be set as True.

After triggered by the onset probability, the calculation of impulsive noise probability is based on the decay trend, as the impulsive noise has a decay nature within a short period of time, which may not be present in the increase of the noise floor. For example, in FIG. 5(*a*) where the excitation pattern of raw signal level at 1 kHz band as a function of time is shown, the noise includes an abrupt level changed from 0 dB to around 30 dB at around 1.8 seconds and lasts for more than 5 seconds. This noise also includes a door slam at around 7.6 seconds, which has an onset of 40 dB and lasts for only 1.6 seconds. Although the door slam part contains a lot of variations in the magnitude over time, the general level is decaying.

When determining whether the noise signal has a decay trend, in accordance with an example embodiments disclosed herein, a maximal signal level of the noise signal within a first time window may be determined first, and then whether the noise signal has the decay trend may be determined based on a distance between the maximal signal level and the signal level of the noise signal. In this case, the block of maximum tracking 305 is used to track the maximal signal level within the first time window. The block of maximum tracking 305 may begin to operate when the block of impulsive noise probability 306 begins calculating. In other words, the maximum tracking may also be triggered by the onset probability in some embodiments, and may also be triggered by whether the impulse status indicator is False in some other embodiments. The original value of the maximal signal level may be set as the signal level of the noise signal in some example embodiments disclosed herein. For example, the original value of the maximal signal level may be set as the raw signal level X(f,t), the slow smoothed signal level $X_{sm2}(f,t)$ or the fast smoothed signal level $X_{sm1}(f,t)$.

In some example embodiments, the length of the first time window may be predetermined, such as 2 seconds or 3 seconds. As the impulsive noise has a decay nature, and the maximal signal level remains the same within a period of time as the time window is shifted, the distance between the maximal signal level and the signal level of the impulsive noise is relatively large at this period of time. The signal level of impulsive noise may be the output of the fast smoothing block 302 as illustrated in FIG. 3, and may also be the raw signal level or the output of the slow smoothing block 303. As such, the decay trend in the noise signal may be detected. In order to decide that the noise signal has a decay trend, a threshold may be used to measure if the distance is so large that a decay trend is probably contained in this noise.

There are many other ways to determine whether the noise signal has a decay trend. In accordance with another example embodiments disclosed herein, the determination of whether the noise signal has the decay trend is determined based on a slope of the noise signal over time. For example, a slope of the magnitudes of the noise signal at two points of time may be calculated, and if this slope is negative, it means that the noise level is decaying between these two points of time. In other examples, in order to improve confidence, multiple slopes may be determined By analyzing the slopes, it may be determined whether there is a decay trend in the noise signal.

According to some example embodiments disclosed herein, when calculating the impulsive noise probability, if the noise signal is determined to have a decay trend, it means that the noise signal may probably be an impulsive noise, and versa visa. As such, the impulsive noise probability is increased at a first rate when the noise signal has the decay trend, and the impulsive noise probability is decreased at a second rate when the noise signal has no decay trend. For example, if the decay trend is determined by the distance between the maximal signal level and the signal level of the noise signal, the impulsive noise probability may be calculated as follows:

$$P_{imp}(f,t) = \begin{cases} \min[\alpha_i P_{imp}(f,t-\Delta t) + (1-\alpha_i)*1, 1], & \text{when } S_{imp}(f,t) = \text{True, and } D_{dB}(f,t) > D_0 \\ \max[P_{imp}(f,t-\Delta t)*0.9, P_{on}(f,t-\Delta t)] & \text{otherwise} \end{cases} \quad (8)$$

$$D_{dB}(f,t) = X_{max,dB}(f,t) - X_{sm1,dB}(f,t) \quad (9)$$

wherein $P_{imp}(f,t)$ represents the impulsive noise probability; $D_{dB}(f\ t)$ represents the distance between the maximal signal level $X_{max,dB}(f,t)$ and the fast smoothed signal level $X_{sm1,dB}(f,t)$; $S_{imp}(f,t)$ represents the impulse status indicator; $D_0$ represents the threshold used to determine whether the noise signal has a decay trend, the value of which may be 6 dB in one example; and $\alpha_i$ represents a linear domain smoothing factor used to smooth the impulsive noise probability and is between 0 and 1.

If the distance is larger than $D_0$, it may be regarded as a positive sign of impulsive noise, and otherwise a negative sign. Through the calculation of the impulsive noise probability in Equation (8), if there is no decay trend, $P_{imp}(f,t)$ is going down as the noise signal does not look like an impulse, and if there is a decay trend, $P_{imp}(f,t)$ is going up.

As noted above, the calculation of impulsive noise probability may be performed band by band. Considering the decay trends of the noise signal may occur at different times for different frequency bands, if the noise signals in one or more frequency bands are determined to have a decay trend, it means that the other frequency bands may also decay sooner or later. As such, if the calculated impulsive noise probability for at least one frequency band of the noise input signal is higher than a confidence threshold, the impulsive noise probabilities for the remaining frequency bands are increased. Then, an accurate decision for the distinguishment of the impulsive noise and noise floor increase may be accelerated at all frequency bands. For example, if the impulsive noise probability of noise signal in B1(f≤700 Hz) is determined first to be 0.6, which is higher than the confidence threshold 0.5, then the impulsive noise probabilities of noise signals in other frequency bands may be increased to 0.6.

It should be noted that, in the above case, the increase of impulsive noise probabilities for the remaining frequency bands may not necessarily be the same, and in some example embodiments, not all impulsive noise probabilities for the remaining frequency bands are increased. The scope of the example embodiments disclosed herein are not limited in this regard.

As the onset of increase usually occurs at the early stage, the onset probability may be smaller at the ending of an impulse, and then the impulsive noise probability may also decrease at this point of time. Another sign of the ending of the impulse is that a distance between the current estimated level of the noise signal and the signal level of the noise signal is lower than an error tolerance, because the estimated level is designed to resist the impulsive noise. In some examples, the signal level of the noise signal used here may be the raw noise level, or may be the fast or slow smoothed noise level output from the block 302 (fast smoothing) or 303 (slow smoothing).

As such, the block of maximum tracking 305 may keep tracking the maximum of noise level until the onset probability is lower than a second predetermined probability threshold and a distance between the current estimated level of the noise signal and the signal level of the noise signal is lower than a predetermined distance threshold. Under these conditions, the maximal signal level is decreased in further example embodiments disclosed herein. In some examples, the maximal signal level may be decreased to the raw noise level, the fast or slow smoothed noise level, or the estimated noise level at the time of the above conditions are met. For example, when the following conditions are met:

$$P_{on}(f,t)<0.2 \text{ and } |Y(f,t)-X_{sm2,dB}(f,t)|<X_{0,dB} \quad (10)$$

the maximal signal level $X_{max,dB}(f,t)$ may be set as:

$$X_{max,dB}(f,t)=Y(f,t) \quad (11)$$

where $X_{0,dB}$ represents a constant for error tolerance, and its value may be set as 1 dB in an example. The conditions in Equation (10) generally indicate the ending of an impulse as the signal level of the noise signal $X_{sm2,dB}(f,t)$ may go down to the estimated level Y(f,t). In this case, the maximal signal level may also be set to Y(f,t).

As noted above, an impulse status indicator may be used to indicate whether the noise signal is currently estimated as an impulsive noise. Since the conditions in Equation (10) indicate the ending of an impulse, the impulse status indicator may also be changed to False, which may then stop the maximum tracking in some embodiments.

It should be noted that if the decay trend is determined by other ways instead of the distance $D_{dB}(f,t)$, the above Equation (8) may also be used. In this case, the condition $D_{dB}(f,t)>D_0$ in Equation (8) may generally be covered by the noise signal having a decay trend. It should also be noted that the impulsive noise may be calculated in other ways, as long as the impulsive noise probability increases if a decay trend is detected and decreases if no decay trend is detected.

With reference to FIG. 5(*a*), it can be seen that there are large variations of magnitude over time even during the presence of impulse. For example, from 16.1 seconds to 17.1 seconds in the raw noise signal shown in FIG. 5(*a*), there are four quick knocks in series on the door. The four impulses are so close that there is no pause in between. In this case, the block of onset probability is triggered frequently. When onset is just detected, the impulse noise probability has not been established. At this time if another onset follows immediately, the smoothing utilizing the calculated impulsive noise probability may be disturbed. As such, the block of impulsive noise probability 306 may also count the time the newest impulse has lasted. In accordance with some example embodiments disclosed herein, an impulse establishment time is recorded when beginning to calculate the impulsive noise probability. The impulse establishment time may be recorded by the block 306 in FIG. 3 in an example. In these embodiments, the impulse establishment time is set to zero when the onset probability is higher than the first predetermined threshold. As noted above, when the onset probability is higher than the first predetermined threshold, the calculation of impulsive noise probability may be triggered, which means that a new onset is detected. At this time, the impulse establishment time may be set to zero and the time the new detected impulse has may be recorded. As illustrated in FIG. 3, the impulse establishment time $T_{imp}(f,t)$ is output to the block of adaptive smoothing 307 to facilitate the operations of this block.

The Block of Adaptive Smoothing 307

The block of adaptive smoothing 307 in FIG. 3 may be used to perform the determination of the variable smoothing factor at step S202 of the method 200 and the smoothing based on the variable smoothing factor at step S203 of the method 200. As such, in one example embodiment, the block 307 may have the input of the noise signal from the block 301, the onset probability from the block 304, and the impulsive noise probability and the impulse establishment time from the block 306.

As noted above, the variable smoothing factor is determined based on the impulsive noise probability, and in some embodiments, the impulse establishment time may be used to avoid any disturbing aspects by a series of onsets. More particularly, the variable smoothing factor is determined based on a reference smoothing factor and a maximum of the impulsive noise probability and the onset probability, when the impulse establishment time is lower than a predetermined time threshold; and the variable smoothing factor is determined based on the reference smoothing factor and the impulsive noise probability, when the impulse establishment time is higher than or equal to the predetermined time threshold. In determination, the variable smoothing factor may be a decreasing function of the impulsive noise probability over time. In other words, the variable smoothing factor is increased as the impulsive noise probability is increased over time, and the variable smoothing factor is decreased as the impulsive noise probability is decreased over time. For example, the variable smoothing factor $\alpha(f,t)$ may be determined as the following:

$$\alpha(f,t)=\begin{cases}\alpha_d+(1-\alpha_d)\max[P_{imp}(f,t),P_{on}(f,t)], & \text{when } 0<T_{imp}(f,t)<T_0\\ \alpha_d+(1-\alpha_d)P_{imp}(f,t), & \text{otherwise}\end{cases} \quad (12)$$

where $\alpha_d$ represents the reference smoothing factor and is between 0 and 1, $\alpha(f,t)$ is determined as between $\alpha_d$ and 1 according to Equation (12); and $T_0$ represents a time constant. It would be understood from Equation (12) that when onset is just detected, the impulsive noise probability has not been established, in order to avoid following up other onsets, max $[P_{imp}(f,t)]$ is used to calculate $\alpha(f,t)$. After $T_0$, the impulsive noise probability has been established, and only $P_{imp}(f,t)$ is used.

As noted above, the estimated level of the noise signal is determined based on the variable smoothing factor. In accordance with some example embodiments disclosed herein, the noise signal is smoothed with the variable smoothing factor; and a smoothed signal level of the smoothed noise signal is determined as the current estimated level of the noise signal. For example, the estimated level may be determined as the following:

$$Y_{dB}(f,t)=\alpha(f,t)Y_{dB}(f,t-\Delta t)+(1-\alpha(f,t))X_{dB}(f,t) \quad (13)$$

where $Y_{dB}(f,t)$ represents the current estimated level in log domain, which is equal to the smoothed signal level; $Y_{dB}(f,t-\Delta t)$ represent the previous estimated level in log domain and $X_{dB}(f,t)$ presents the raw signal level in log domain. In this equation, the variable smoothing factor determined is associated with the previous estimated level and used to smooth the noise signal.

By utilizing Equation (12), the variable smoothing factor increases and decreases as the impulsive noise probability increases and decreases. By smoothing in Equation (13), it can be seen that, the larger the variable smoothing factor is, the slower the changing of the estimated level over time is. As such, if the impulsive noise probability is determined to be large, which means that the noise signal may probably be an impulse, then the estimated level may resist the noise signal, which indicates a slow reacting estimation. For example, if the impulsive noise probability is equal to 1, according to Equations (12) and (13), the estimated level will hold at the previous estimated level and will not follow the increase of impulse level. As such, it appears that the impulsive noise will be ignored in the later audio processing.

As discussed above and as illustrated in FIG. 3, the noise level estimation allows following the noise floor increase and resisting the short-period impulsive noise. For the noise floor increase, as can be seen from Equation (12) for example, if the impulsive noise probability indicates that the noise signal is probably an increase of noise floor, the adaptive smoothing factor will be equal or near to the reference smoothing factor, which is used for smoothing the noise signal without an abrupt increase and may be usually small. Then when determining the estimated level by this adaptive smoothing factor, the estimated level may increase slowly from the level before the onset to the later stationary level of the noise floor. This latency is desired to be reduced.

Figure 4:
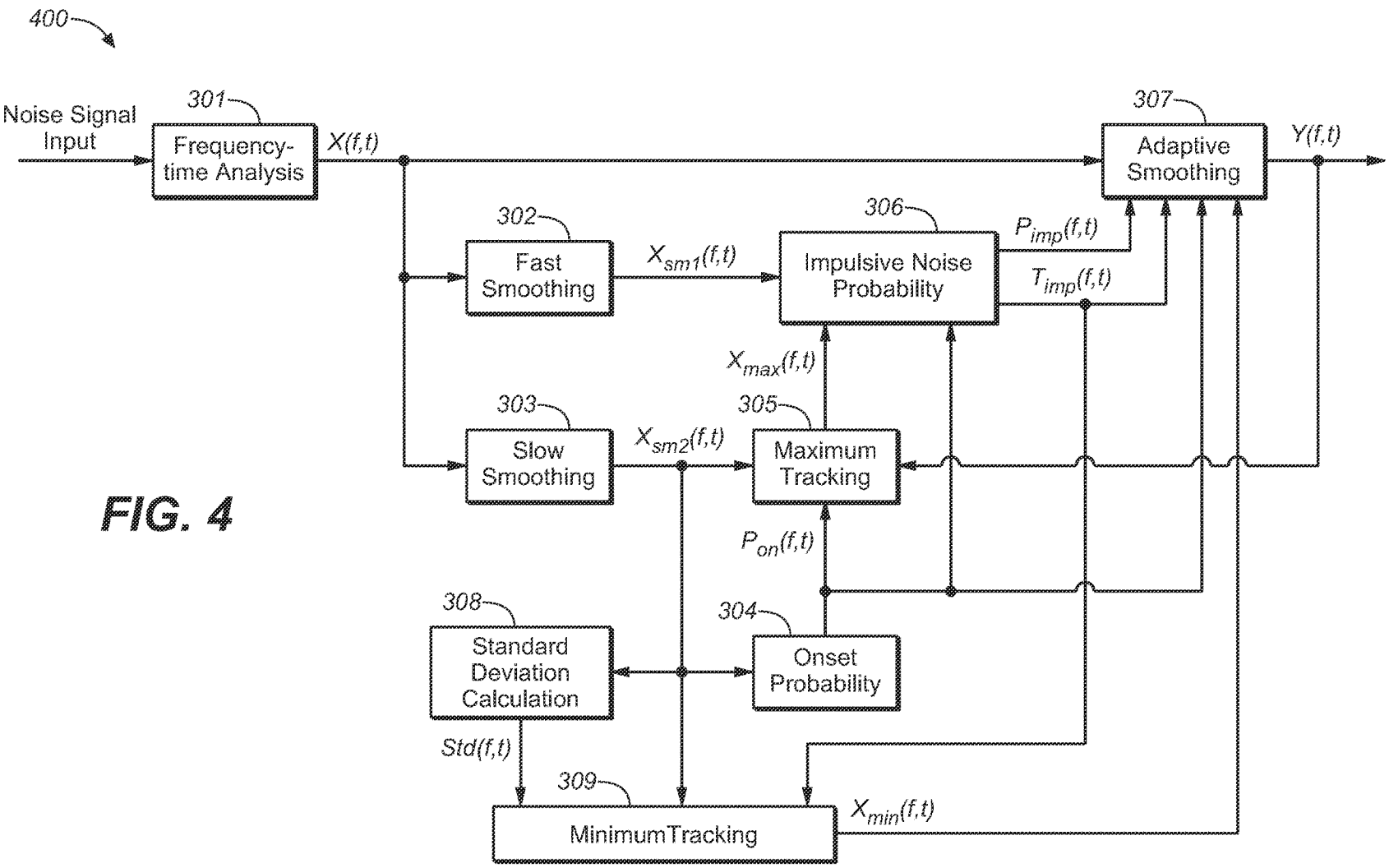
FIG. 4 illustrates a schematic diagram of noise level estimation in accordance with another example embodiments disclosed herein.
Figure 5A:
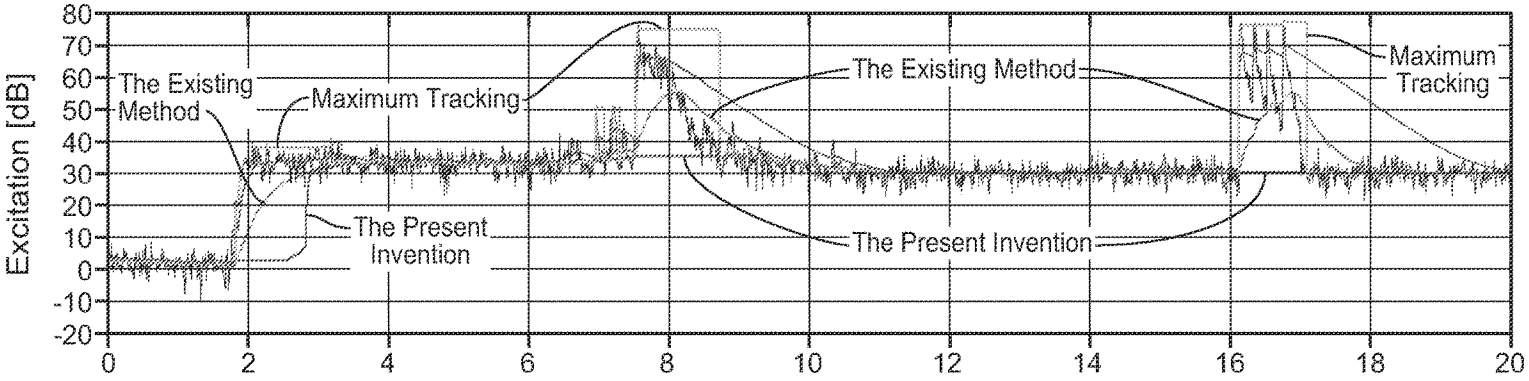
FIG. 5(*a*) illustrates a comparison of the estimated noise level in accordance with an existing method and an example embodiments disclosed herein.
Figure 5B:
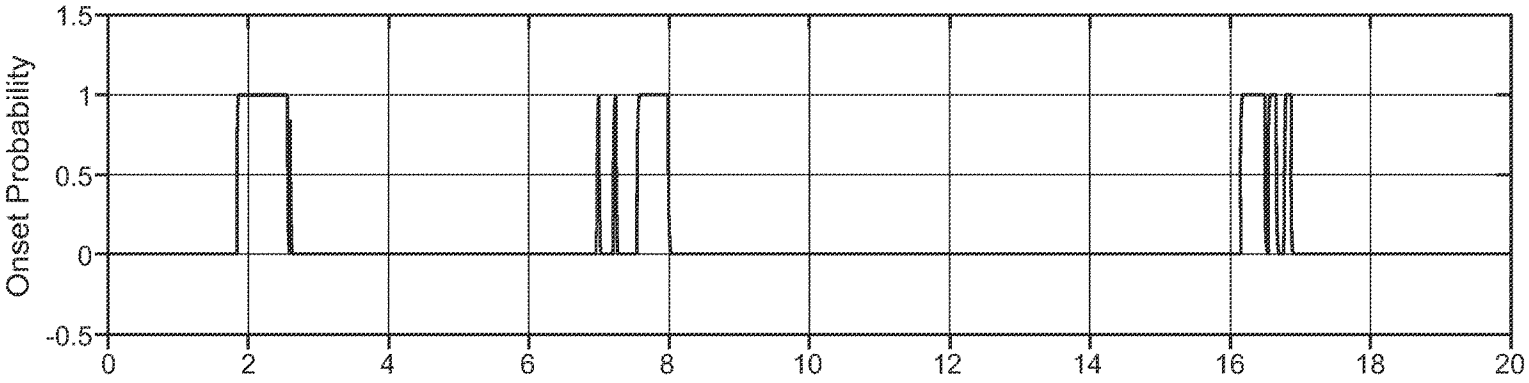
Figure 5C:
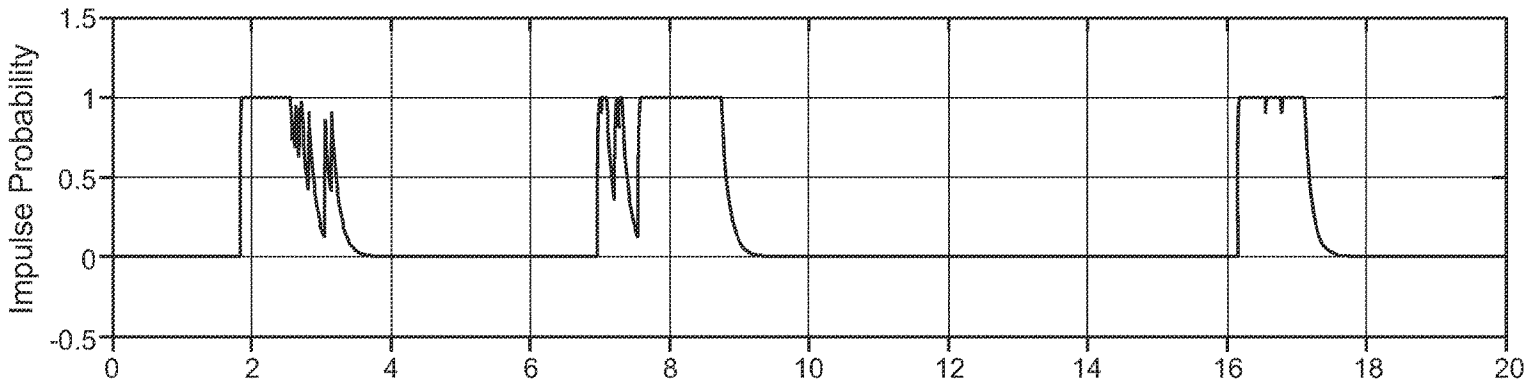
Figure 5D:
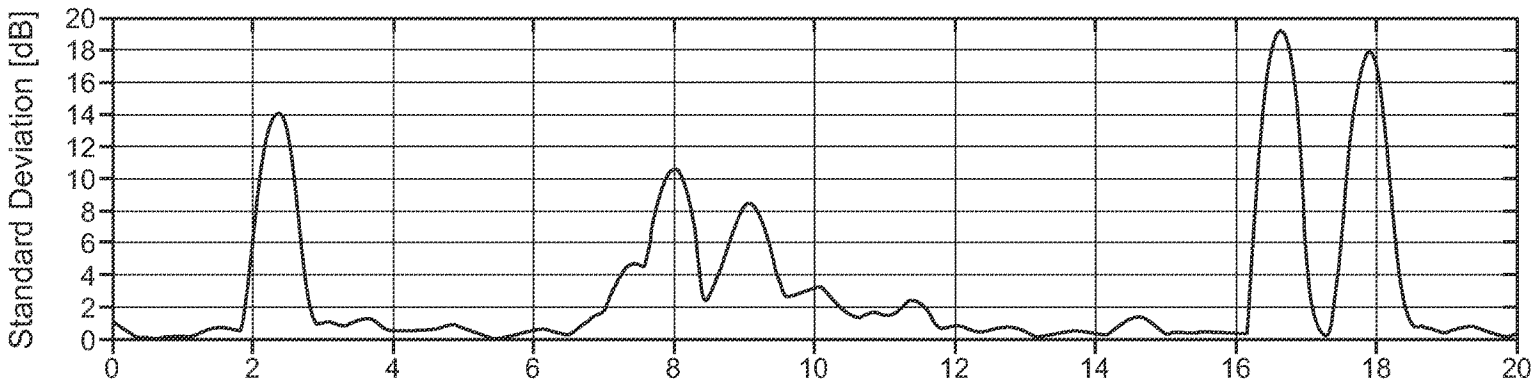

Reference is now made to FIG. 4, which illustrates a schematic diagram of noise level estimation in accordance with another example embodiments disclosed herein. For purposes of illustration, certain references with respect to FIG. 3 are maintained the same. In FIG. 4, additional blocks are added to reduce the latency of noise level estimation in the case of noise floor increase.

The Block of Minimum Tracking 309

As stated above, when onset is likely to be caused by an abrupt increase of noise floor, the estimated noise level is desired to be brought up instantly. In order to achieve this target, the block of minimum tracking 309 may be used to track a minimal signal level of the noise signal within a second time window. In the abrupt increase of noise floor, if the increased level of noise floor is within the second time window and then is determined as the minimal signal level, in accordance with some example embodiments disclosed herein, the estimated noise level may be directly set to this minimal signal level as it is larger than the level smoothed with the low variable smoothing factor as discussed in the above. As such, the operation of the block 307 may comprise: smoothing the noise signal with the variable smoothing factor; and selecting the maximum of a smoothed signal level of the smoothed noise signal and the minimal signal level as the current estimated level of the noise signal. In some examples, Equation (13) may be modified as:

$$Y_{dB}(f,t)=\max[\alpha(f,t)Y_{dB}(f,t-\Delta t)+(1-\alpha(f,t)X_{dB}(f,t),\ X_{min,dB}(f,t)] \quad (14)$$

where $X_{min,dB}(f,t)$ represents the determined minimal signal level in log domain. According to Equation (14), the current estimated noise level may be brought up if the minimal signal level $X_{min,dB}(f,t)$ is determined as the lowest level at the stage the noise floor level has increased and remains stationary.

The length of the second time window may be predetermined, for example, as 2 seconds, and the scope of the example embodiments disclosed herein are not limited in this regard.

As can be seen from the working mechanism of the block of minimum tracking 309, the length of the second time window may impact the time the minimal signal level taken to be determined as the lowest level at the stationary stage of the noise floor. The lowest level at the stationary stage may be tracked quickly if a smaller time window is used. As such, in accordance with some example embodiments disclosed herein, the second time window may be adaptively narrowed down as the noise floor is becoming stable.

In these embodiments, a degree of stability of the noise signal may be determined; and the second time window may be narrowed down when the degree of stability is lower than a predetermined stability threshold and the impulse establishment time is lower than the predetermined time threshold, such that the minimal signal level of the noise signal within the narrowed second time window is larger than the smoothed signal level.

The degree of stability may be used to measure how stable the noise signal is, as the noise floor may trend to be stationary at last. Moreover, only the degree of stability may not be enough to decide that the second time window should be narrowed down as the impulsive noise may also go down to a stable level. Therefore, the impulse establishment time $T_{imp}(f,t)$ may be used to limit that if the noise signal becomes stationary at an early stage, as there is a tendency that the onset may be actually caused by a noise floor increase. Under this condition, the second time window is desired to be narrowed down so as to bring the estimated noise level instantly as shown in Equation (14).

For example, the second time window W(f,t) may be determined as follows:

$$W(f,t) = \begin{cases} W_S & \text{when } Stab. < St \text{ and } 0 < T_{imp}(f,t) < T_0 \\ W_L & \text{otherwise} \end{cases} \quad (15)$$

where $W_S$ represents the narrowed time window, which may have a value of 1 second for example; $W_L$ represents the long time window before being narrowed down, which may have a value of 2 seconds for example and Stab. represents the degree of stability and St represents the stability threshold.

In accordance with some other embodiments, the degree of stability is measured by a variance or standard deviation of the noise signal within a predetermined measurement time window. Additionally or alternatively, many other parameters may be used to measure the degree of stability, for example, the probability of the noise floor increase, which may be equal to 1 minus the impulsive noise probability. The scope of the example embodiments disclosed herein are not limited in this regard.

It should also be noted that the shorter second time window may always be used by the block of minimum tracking 309 to track the minimal signal level. That is, the second time window may not necessarily to be changed but remain short enough so as to enable the estimated level being brought up quickly when needed.

The Block of Standard Deviation Calculation 308

In accordance with some example embodiments disclosed herein, the standard deviation of the noise signal may be used to measure the degree of stability of the noise signal, and this block 308 may be used to calculate the standard deviation. It should be noted that if other parameters are additionally or alternatively required to measure the degree of stability, this block 308 may be replaced or other blocks may be added.

In some examples, the standard deviation may be calculated as follows:

$$Std_x(f,t) = \sqrt{\frac{\sum_{m=0}^{M} X_{sm2}^2(f, t - m\Delta t)}{M-1}} \quad (16)$$

$$Std_{smx,dB}(f,t) = \alpha_S Std_{smx,dB}(f, t-\Delta t) + (1-\alpha_S) Std_{x,dB}(f,t) \quad (17)$$

$$Std(f,t) = \sqrt{\frac{\sum_{n=0}^{N} Std_{smx}^2(f, t - n\Delta t)}{N-1}} \quad (18)$$

where Equation (16) calculates the standard deviation of the slow smoothed noise signal $X_{sm2}(f,t)$ within a time window of mΔt, and in other examples, the standard deviation of the fast smoothed noise signal $X_{sm1}(f,t)$ or the raw noise signal X(f,t) may be calculated. Equation (17) is used to smooth the standard deviation of Equation (16) in log domain, and $\alpha_S$ is the smoothing factor that is between 0 and 1. Equation (18) normalizes the smoothed standard deviation so that Std(f,t) is all above zero and is irrelevant with the magnitude of $X_{sm2}(f,t)$ which makes it easier to set a threshold for judging how stationary the noise signal is. In other words, Std(f,t) is the standard deviation of the smoothed standard deviation of $X_{sm2}(f,t)$ in log domain within a time window of not. In some examples, the value of mot may be 0.5 second and the value of not may be 0.8 seconds. The scope of the present invention is not limited in this regard.

The processing of noise level estimation has been described in details with reference to FIGS. 2-4 in the above. Reference is now made to FIG. 5(*a*), which shows the comparison of the estimated noise level in accordance with an existing method and an example embodiment of the present invention. FIG. 5(*b*)-(*d*) illustrates graphs of the parameters used in the example embodiment of FIG. 5(*a*).

As can be seen from FIG. 5(*a*), the noise signal includes an abrupt level changed from 0 dB to around 30 dB at around 1.8 seconds, a door slam at around 7.6 seconds, and four quick knocks in series on the door from 16.1 seconds to 17.1 seconds. The door slam and four knocks may be regarded as impulsive noises. In FIG. 5(*a*), it shows the estimated noise level tracked by an existing method. The idea of this method is that when onset is detected, no matter whether the onset is caused by an increase of noise floor or an impulsive noise (these two types of noise signal cannot be distinguished in the existing method), the estimated noise level will track the actual signal level of the noise signal. This results in the estimated noise level following the increase of the impulsive noise as illustrated in FIG. 5(*a*), which is not desired for the later audio processing. However, the estimated noise level in the example embodiments disclosed herein, as illustrated in FIG. 5(*a*), follows the increase of noise floor and resists the short-period impulsive noises (door slam or quick knocks), which is more robust.

Figure 6:
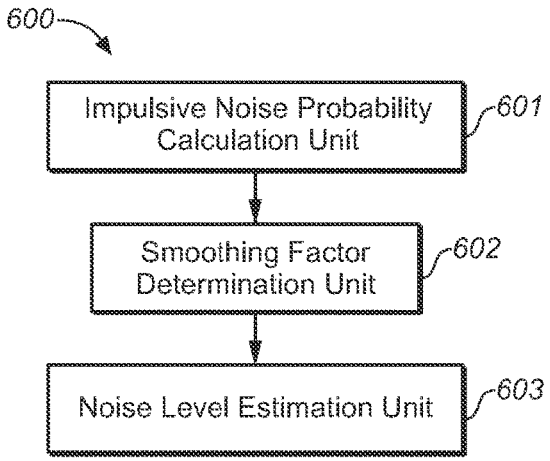
FIG. 6 illustrates a block diagram of a system for noise level estimation in accordance with an example embodiments disclosed herein.

FIG. 6 shows a block diagram of a system 600 for noise level estimation in accordance with one example embodiment. As shown, the system 600 includes an impulsive noise probability calculation unit 601 configured to calculate an impulsive noise probability of a noise signal responsive to an increase of a signal level of the noise signal, the impulsive noise probability indicating a likelihood that the noise signal is an impulsive noise. The system 600 also comprises a smoothing factor determination unit 602 configured to determine a variable smoothing factor for noise level estimation based on the impulsive noise probability, the variable smoothing factor being associated with a previously estimated level of the noise signal. The system 600 further comprises a noise level estimation unit 603 configured to smooth the noise signal with the variable smoothing factor so as to determine a current estimated level of the noise signal.

In some example embodiments, the noise signal may be a signal in one of a plurality of frequency bands of a noise input signal, or is a broadband signal of the noise input signal. In these embodiments, if the calculated impulsive noise probability for at least one frequency band of the noise input signal is higher than a confidence threshold, the impulsive noise probabilities for the remaining frequency bands may be increased.

In some embodiments, the system 600 may further comprise an onset probability determination unit, configured to determine an onset probability of the noise signal, the onset probability indicating a likelihood of the increase of the signal level. In these embodiments, the impulsive noise probability calculation unit 601 may comprise an initial value setting unit, configured to set an initial value of the impulsive noise probability as the onset probability when the onset probability is higher than a first predetermined probability threshold and a decay determination unit, configured to determine whether the noise signal has a decay trend, wherein the impulsive noise probability calculation unit 601 may be further configured to calculate the impulsive noise probability of the noise signal based on whether the noise signal has the decay trend.

Furthermore, in some embodiments, the decay determination unit may be further configured to perform at least one of the following: determine whether the noise signal has the decay trend based on a distance between the signal level of the noise signal and a maximal signal level of the noise signal within a first time window or determine whether the noise signal has the decay trend based on a slope of the noise signal over time.

In addition, in some embodiments, the impulsive noise probability calculation unit 601 may be further configured to increase the impulsive noise probability at a first rate when the noise signal has the decay trend; and decrease the impulsive noise probability at a second rate when the noise signal has no decay trend.

Further, in some embodiments, the system 600 may further comprise a maximum decreasing unit, configured to decrease the maximal signal level when the onset probability is lower than a second predetermined probability threshold, and a distance between the current estimated level of the noise signal and the signal level of the noise signal is lower than a predetermined distance threshold.

Further, in some embodiments, the system 600 may further comprise an impulse establishment time recording unit, configured to record an impulse establishment time when beginning to calculate the impulsive noise probability, wherein the impulse establishment time recording unit may be further configured to set the impulse establishment time to zero when the onset probability is higher than the first predetermined threshold.

In some embodiments, the smoothing factor determination unit 602 may be further configured to determine the variable smoothing factor based on a reference smoothing factor and a maximum of the impulsive noise probability and the onset probability, when the impulse establishment time is lower than a predetermined time threshold and determine the variable smoothing factor based on the reference smoothing factor and the impulsive noise probability, when the impulse establishment time is higher than or equal to the predetermined time threshold. In these embodiments, when determining the variable smoothing factor, the variable smoothing factor is a decreasing function of the impulsive noise probability over time.

In some embodiments, the noise level estimation unit 603 may be further configured to smooth the noise signal with the variable smoothing factor and determine a smoothed signal level of the smoothed noise signal as the current estimated level of the noise signal.

Further, in some embodiments, the system 600 may further comprise a minimum determination unit, configured to determine a minimal signal level of the noise signal within a second time window. In these embodiments, the noise level estimation unit 603 may be further configured to smooth the noise signal with the variable smoothing factor and select a maximum of a smoothed signal level of the smoothed noise signal and the minimal signal level as the current estimated level of the noise signal.

Further, in some embodiments, the system 600 may further comprise a stability degree determination unit, configured to determine a degree of stability of the noise signal; and a time window narrowing unit, configured to narrow down the second time window when the degree of stability is lower than a predetermined stability threshold and the impulse establishment time is lower than the predetermined time threshold, such that the minimal signal level of the noise signal within the narrowed second time window is larger than the smoothed signal level.

In some embodiments, the degree of stability may be measured by a variance or standard deviation of the noise signal within a predetermined measurement time window.

For the sake of clarity, some optional components of the system 600 are not shown in FIG. 6. However, it should be appreciated that the features as described above with reference to FIGS. 2-5 are all applicable to the system 600. Moreover, the components of the system 600 may be a hardware module or a software unit module. For example, in some embodiments, the system 600 may be implemented partially or completely with software and/or firmware, for example, implemented as a computer program product embodied in a computer readable medium. Alternatively or additionally, the system 600 may be implemented partially or completely based on hardware, for example, as an integrated circuit (IC), an application-specific integrated circuit (ASIC), a system on chip (SOC), a field programmable gate array (FPGA), and so forth. The scope of the example embodiments disclosed herein are not limited in this regard.

Figure 7:
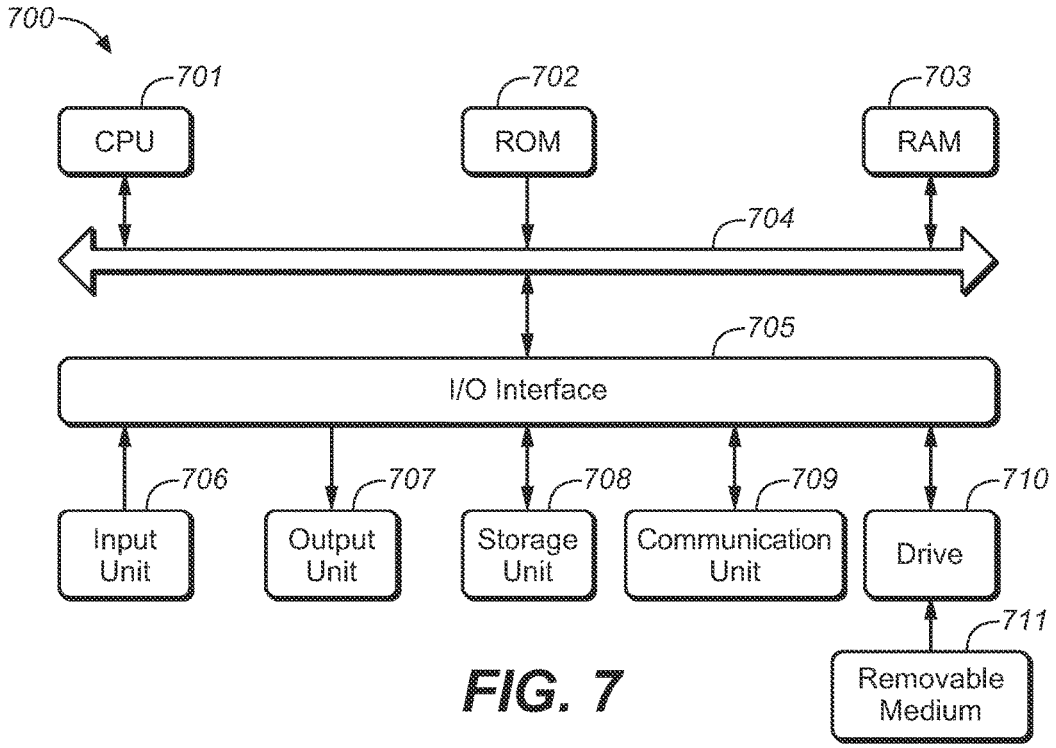
FIG. 7 illustrates a block diagram of an example computer system suitable for implementing example embodiments disclosed herein.

FIG. 7 shows a block diagram of an example computer system 700 suitable for implementing example embodiments disclosed herein. As shown, the computer system 700 comprises a central processing unit (CPU) 701 which is capable of performing various processes in accordance with a program stored in a read only memory (ROM) 702 or a program loaded from a storage section 708 to a random access memory (RAM) 703. In the RAM 703, data required when the CPU 701 performs the various processes or the like is also stored as required. The CPU 701, the ROM 702 and the RAM 703 are connected to one another via a bus 704. An input/output (I/O) interface 705 is also connected to the bus 704.

The following components are connected to the I/O interface 705: an input section 706 including a keyboard, a mouse, or the like; an output section 707 including a display such as a cathode ray tube (CRT), a liquid crystal display (LCD), or the like, and a loudspeaker or the like; the storage section 708 including a hard disk or the like; and a communication section 709 including a network interface card such as a LAN card, a modem, or the like. The communication section 709 performs a communication process via the network such as the internet. A drive 710 is also connected to the I/O interface 705 as required. A removable medium 711, such as a magnetic disk, an optical disk, a magneto-optical disk, a semiconductor memory, or the like, is mounted on the drive 710 as required, so that a computer program read therefrom is installed into the storage section 708 as required.

Specifically, in accordance with example embodiments disclosed herein, the processes described above with reference to FIGS. 2-6 may be implemented as computer software programs. For example, embodiments disclosed herein include a computer program product including a computer program tangibly embodied on a machine readable medium, the computer program including program code for performing methods 200. In such embodiments, the computer program may be downloaded and mounted from the network via the communication section 709, and/or installed from the removable medium 711.

Generally speaking, various example example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example example embodiments disclosed herein are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, example embodiments disclosed herein include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include but is not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the example embodiments disclosed herein may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination.

Various modifications, adaptations to the foregoing example embodiments of this invention may become apparent to those skilled in the relevant arts in view of the foregoing description, when read in conjunction with the accompanying drawings. Any and all modifications will still fall within the scope of the non-limiting and example embodiments of this invention. Furthermore, other embodiments of the inventions set forth herein will come to mind to one skilled in the art to which these embodiments of the invention pertain having the benefit of the teachings presented in the foregoing descriptions and the drawings.

Accordingly, the example embodiments disclosed herein may be embodied in any of the forms described herein. For example, the following enumerated example embodiments (EEEs) describe some structures, features, and functionalities of some aspects of the present invention.

EEE 1. A method for estimating non-stationary noise levels, which includes:

a. an estimator of impulsive noise probability;
b. an adaptive smoother with impulsive noise probability controlled time constants; and
c. a method to speed up the tracking when the onset is not caused by an impulse but an abrupt noise floor increase.

EEE 2. The estimator according to EEE 1, wherein the impulsive noise probability is estimated using:

a. onset probability; and
b. decaying nature of impulsive noise after the quick onset.

EEE 3. The smoothing method according to EEE 2, wherein the decaying nature of the impulsive noise is measured by the distance between the instantaneous or smoothed noise level and the noise level output from a maximum tracker.

EEE 4. The smoothing method according to EEE 2, wherein the decaying nature of the impulsive noise is measured by calculating the slope (gradient) or smoothed slope of magnitude over time.

EEE 5. The method according to EEE 1, wherein features are extracted to judge the likelihood of an abrupt increase of noise floor.

EEE 6. The method according to EEE 4, including variance or standard deviation of magnitude over time.

EEE 7. The method according to EEE 1, wherein the tracking speeds up by using minimum tracker.

EEE 8. The method according to EEE 1, wherein the tracking speeds up by remembering one or a few previous estimation levels from quick smoothers.

EEE 9. The method according to EEE 7, wherein the length of the minimum tracking window is controlled by judging the likelihood of an abrupt increase of noise floor.

It will be appreciated that the example embodiments disclosed herein are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method for noise level estimation, comprising:

responsive to an increase of a signal level of a noise signal, calculating an impulsive noise probability of the noise signal, the impulsive noise probability indicating a likelihood that the noise signal is an impulsive noise;

determining a variable smoothing factor for noise level estimation based on the impulsive noise probability, the variable smoothing factor being associated with a previous estimated level of the noise signal; and smoothing the noise signal with the variable smoothing factor so as to determine a current estimated level of the noise signal.

2. The method according to claim 1, further comprising:

determining an onset probability of the noise signal, the onset probability indicating a likelihood of the increase of the signal level.

3. The method according to claim 2, wherein calculating the impulsive noise probability of the noise signal comprising:

setting an initial value of the impulsive noise probability as the onset probability, when the onset probability is higher than a first predetermined probability threshold;

determining whether the noise signal has a decay trend; and calculating the impulsive noise probability of the noise signal based on whether the noise signal has the decay trend.

4. The method according to claim 3, wherein determining whether the noise signal has the decay trend comprising at least one of:

determining whether the noise signal has the decay trend based on a distance between the signal level of the noise signal and a maximal signal level of the noise signal within a first time window; or determining whether the noise signal has the decay trend based on a slope of the noise signal over time.

5. The method according to claim 3, wherein calculating the impulsive noise probability of the noise signal based on whether the noise signal has the decay trend comprising:

increasing the impulsive noise probability at a first rate when the noise signal has the decay trend; and decreasing the impulsive noise probability at a second rate when the noise signal has no decay trend.

6. The method according to claim 4, further comprising:

decreasing the maximal signal level when the onset probability is lower than a second predetermined probability threshold and a distance between the current estimated level of the noise signal and the signal level of the noise signal is lower than a predetermined distance threshold.

7. A system for noise level estimation, comprising:

an impulsive noise probability calculation unit, configured to calculate an impulsive noise probability of a noise signal responsive to an increase of a signal level of the noise signal, the impulsive noise probability indicating a likelihood that the noise signal is an impulsive noise;

a smoothing factor determination unit, configured to determine a variable smoothing factor for noise level estimation based on the impulsive noise probability, the variable smoothing factor being associated with a previous estimated level of the noise signal; and a noise level estimation unit, configured to smooth the noise signal with the variable smoothing factor so as to determine a current estimated level of the noise signal.

8. The system according to claim 7, wherein the noise signal is a signal in one of a plurality of frequency bands of a noise input signal, or is a broadband signal of the noise input signal;

wherein if the calculated impulsive noise probability for at least one frequency band of the noise input signal is higher than a confidence threshold, the impulsive noise probabilities for the remaining frequency bands are increased.

9. The system according to claim 7, further comprising:

an onset probability determination unit, configured to determine an onset probability of the noise signal, the onset probability indicating a likelihood of the increase of the signal level.

10. The system according to claim 9 wherein the impulsive noise probability calculation unit comprising:

an initial value setting unit, configured to set an initial value of the impulsive noise probability as the onset probability when the onset probability is higher than a first predetermined probability threshold; and a decay determination unit, configured to determine whether the noise signal has a decay trend, wherein the impulsive noise probability calculation unit is further configured to calculate the impulsive noise probability of the noise signal based on whether the noise signal has the decay trend.

11. The system according to claim 10, wherein the decay determination unit is further configured to perform at least one of:

determine whether the noise signal has the decay trend based on a distance between the signal level of the noise signal and a maximal signal level of the noise signal within a first time window; or determine whether the noise signal has the decay trend based on a slope of the noise signal over time.

12. The system according to claim 10, wherein the impulsive noise probability calculation unit is further configured to:

increase the impulsive noise probability at a first rate when the noise signal has the decay trend; and decrease the impulsive noise probability at a second rate when the noise signal has no decay trend.

13. The system according to claim 11, further comprising:

a maximum decreasing unit, configured to decrease the maximal signal level when the onset probability is lower than a second predetermined probability threshold and a distance between the current estimated level of the noise signal and the signal level of the noise signal is lower than a predetermined distance threshold.

14. A computer program product for noise level estimation, the computer program product being tangibly stored on a non-transient computer-readable medium and comprising machine executable instructions which, when executed, cause the machine to perform steps of the method according to claim 1.

15. The method according to claim 1, wherein the current estimated level of the noise signal is determined according to an equation:

$$Y_{dB}(f,t)=\alpha(f,t)Y_{dB}(f,t-\Delta t)+(1-\alpha(f,t))X_{dB}(f,t)$$

wherein $Y_{dB}(f,t)$ is the current estimated level of the noise signal, $\alpha(f,t)$ is the variable smoothing factor, $Y_{dB}(f,t-\Delta t)$ is the previous estimated level of the noise signal, and $X_{dB}(f,t)$ is the noise signal not having been smoothed with the variable smoothing factor.

16. The method according to claim 1, further comprising:

smoothing the noise signal with a first smoothing factor to generate a fast smoothed noise signal, wherein the impulsive noise probability is calculated using the fast smoothed noise signal instead of the noise signal, and wherein the fast smoothed noise signal is not smoothed with the variable smoothing factor.

17. The method according to claim 16, wherein the fast smoothed noise signal is generated according to an equation:

$$X_{sm1,dB}(f,t)=\alpha_1 X_{sm1,dB}(f,t-\Delta t)+(1-\alpha_1)X_{dB}(f,t)$$

wherein $X_{sm1,dB}(f,t)$ is the fast smoothed noise signal, $\alpha_1$ is the first smoothing factor, $X_{dB}(f,t)$ is the noise signal not having been smoothed with the variable smoothing factor, and $X_{sm1,dB}(f,t-\Delta t)$ is the fast smoothed noise signal at a previous point of time.

18. The method according to claim 16, further comprising:

smoothing the noise signal with a second smoothing factor to generate a slow smoothed noise signal, wherein the second smoothing factor is greater than the first smoothing factor, wherein the impulsive noise probability is calculated using the fast smoothed noise signal and the slow smoothed noise signal instead of the noise signal, and wherein the fast smoothed noise signal and the slow smoothed noise signal are not smoothed with the variable smoothing factor.

19. The method according to claim 18, wherein the slow smoothed noise signal is generated according to an equation:

$$X_{sm2,dB}(f,t)=\alpha_2 X_{sm2,dB}(f,t-\Delta t)+(1-\alpha_2)X_{dB}(f,t)$$

wherein $X_{sm2,dB}(f,t)$ is the slow smoothed noise signal, $\alpha_2$ is the second smoothing factor, $X_{dB}(f,t)$ is the noise signal not having been smoothed with the variable smoothing factor, and $X_{sm1,dB}(f,t-\Delta t)$ is the fast smoothed noise signal at a previous point of time.

* * * * *